United States Patent [19]

Putsch et al.

[11] Patent Number: 4,581,960

[45] Date of Patent: Apr. 15, 1986

[54] WATER-PUMP PLIERS

[75] Inventors: Karl Putsch; Ralf Putsch, both of Wuppertal, Fed. Rep. of Germany

[73] Assignee: Knipex-Werk C. Gustav Putsch, Wuppertal, Fed. Rep. of Germany

[21] Appl. No.: 573,750

[22] Filed: Jan. 25, 1984

[30] Foreign Application Priority Data

Feb. 2, 1983 [DE] Fed. Rep. of Germany ..... 3303369
Dec. 23, 1983 [DE] Fed. Rep. of Germany ... 8336960[U]

[51] Int. Cl.[4] ..... B25B 7/04
[52] U.S. Cl. ..... 81/411; 81/394
[58] Field of Search ..... 81/300, 341, 342, 343, 81/344, 347, 348, 350, 351, 385, 391, 393, 394, 405, 407, 408, 409, 410 R, 410 S, 411, 412, 413, 414

[56] References Cited

U.S. PATENT DOCUMENTS 3,161,094 12/1964 Johnson ..... 81/412
4,296,655 10/1981 Tesoro ..... 81/405

FOREIGN PATENT DOCUMENTS 805265 5/1951 Fed. Rep. of Germany ..... 81/411
933860 10/1955 Fed. Rep. of Germany ..... 81/412
112516 11/1944 Sweden ..... 81/412
257808 3/1946 Switzerland ..... 81/394
844490 8/1960 United Kingdom ..... 81/412

*Primary Examiner*—James L. Jones, Jr.
*Attorney, Agent, or Firm*—Martin A. Farber

[57] ABSTRACT

The present invention relates to water-pump pliers having two plier handles which cross each other and are connected to each other by a pivot pin 7 whereby the handles form plier jaws above the region of crossing of the handles and grip sections below the region of crossing of the handles, and in which the first plier handle is adjustable in steps relative to the second plier handle to change the size of the plier jaws. The pivot pin is fitted and guided in a bore defined in the first plier handle and enters into form-locked engagement with the profiled flanks of a slot in the second plier handle, where the slot lies in the crossing region of the handles, and, in order to obtain a structural form which is simple to manufacture, favorable in operation and stable in use, the pivot pin is rendered incapable of turning with respect to the second plier handle.

20 Claims, 14 Drawing Figures

FIG. 3
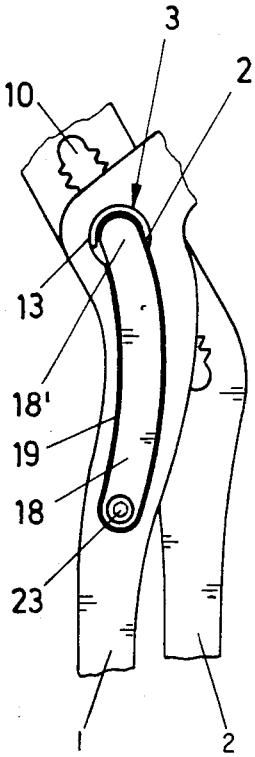
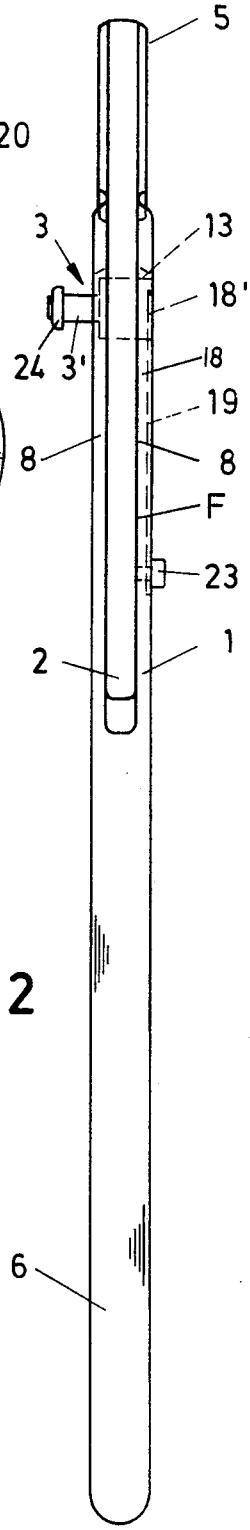
FIG. 2
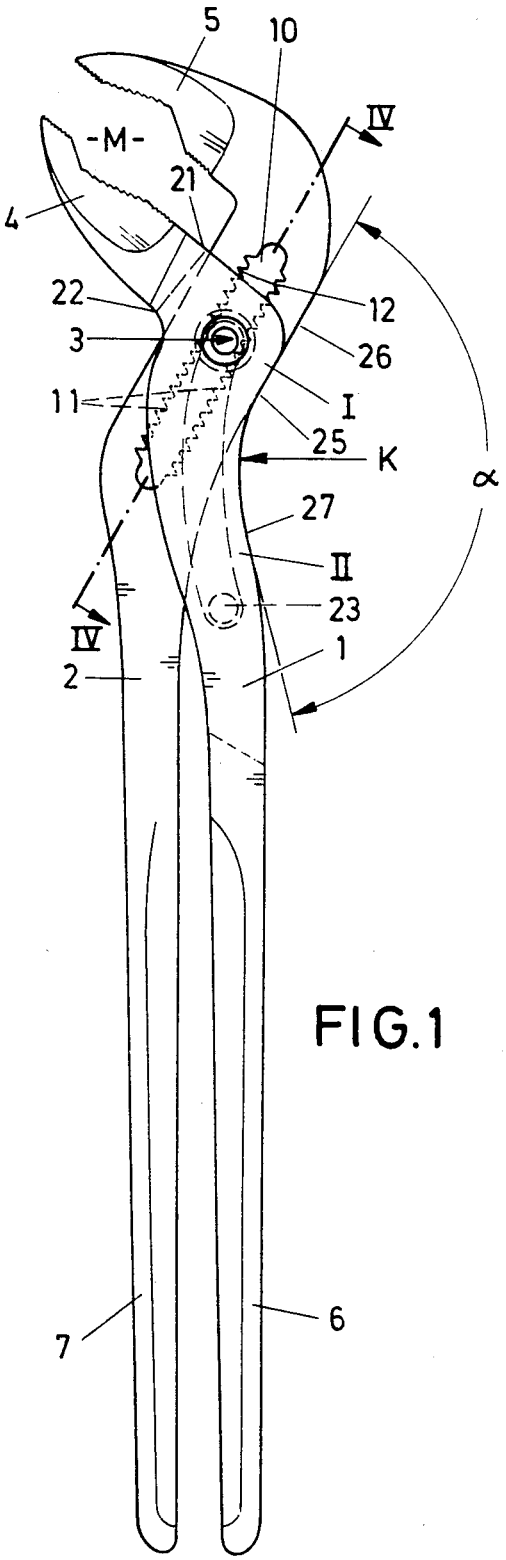
FIG.1

FIG. 14
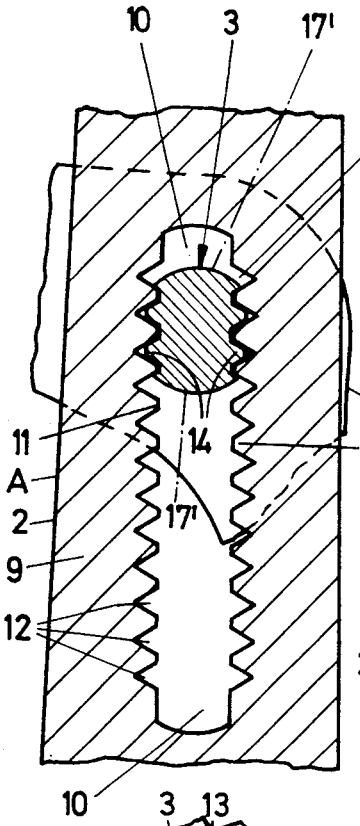
FIG. 13
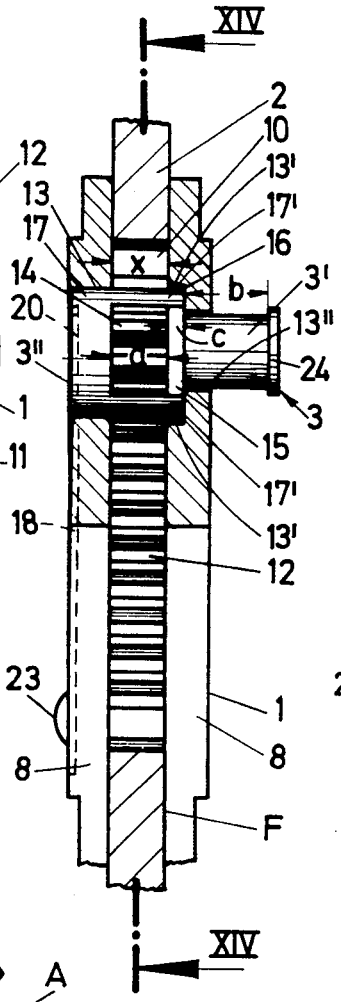
FIG. 11
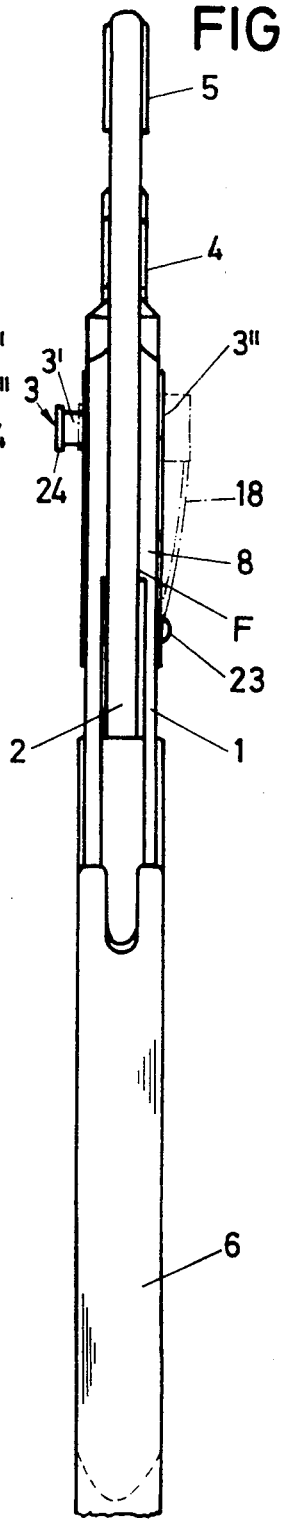
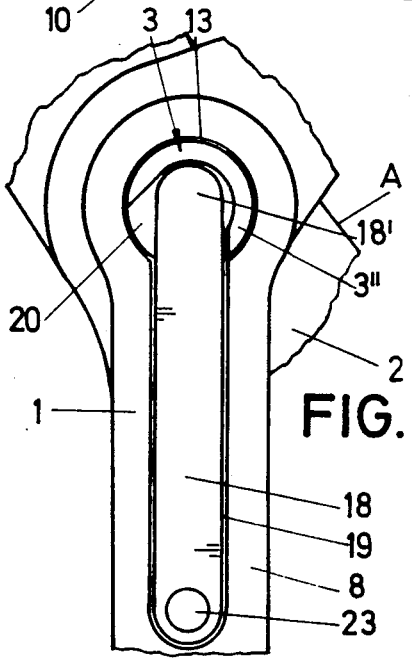
FIG. 12

WATER-PUMP PLIERS

The present invention relates to water-pump pliers.

Water-pump pliers are known in the art having first and second plier handles whch are crossed with respect to each other and are connected together by a pivot pin, the handles forming plier jaws above the region of their crossing and grip sections below the crossing region. In such an arrangement, in order to change the size of the plier jaw, the first plier handle is displaceable in steps at the crossing region relative to the second plier handle, when the latter traverses a free space in the first plier handle. The pivot pin is guided fitted within a bore in the first plier handle and displaceable against a spring which lies transverse to the longitudinal plane of the pliers, the pivot pin having at least first and second cross-sectional regions adjacent each other in an axial direction, the first cross-sectional region, in the coupled condition of the pliers, being in form-locked engagement within the crossing region with the flanks of a slot in the second plier handle, the second cross-sectional region of said pivot pin being freely displaceable in said slot.

The object of the present invention is to develop water-pump pliers of the above type, in a structural form which is simple to manufacture, favorable to handle and stable in use, such that a sensitive adjustment of the jaws is possible and the pivot pin can nevertheless take up high loading forces.

This object is achieved by means for holding the pivot pin (3) incapable of turning with respect to the second plier handle (2) which has the slot (10), even in an uncoupled position.

As a result of this development, pump pliers of the above-described type which are of particularly increased utility are obtained. The pivot pin is incapable of turning with respect to the plier arm bearing the slot, even in disengaged position. In this way, two diametrically opposite regions of the pivot pin can be used for the form-locked coupling engagement of the handles. The profiling of the flanks of the slot in the second handle can be made narrower. This leads to a distribution of the laoding forces over the flanks. Maximum loads which lead to early wear, such as occur on the flanks of hole niches of traditional tools, are avoided. As a whole, there is obtained a more sensitive adjustment, i.e., one which takes place in small steps (and no longer from hole niche to hole niche). The structural expenditure is small. One proceeds such that between the cross sectional region of the pivot pin which produces the form lock and the cylindrical, thinner sectional region provided on the opposite end of the pivot pin there is an intermediate section whose width is less and length greater than the inside distance between the flanks of the slot of the second handle. By the lifting out of the pivot pin, only the thinner cross sectional region forming the above said intermediate section is still present in the slot. The movable plier handle can in this way be displaced freely. The pivot pin is spring loaded in the direction of form-locked engagement. One advantageous embodiment is obtained here in the manner that this spring loading of the pivot pin comes form a leaf spring whose free end rests in a sector-shaped depression on the end of the pivot pin. This, and the further structural measure that the leaf spring is recessed in a groove in the plier handle, avoids any lateral projection after the adjustment. Thus, the spring itself is protected and also it cannot strike in disturbing fashion against projecting areas when the tool is in use. The end of the cylindrical cross-sectional region of the pivot pin has a stop collar placed thereon. The collar operates to define the disengaged position of the pivot pin. The collar cooperates with the end of the pivot point to provide an increased actuating-pressure surface, and may be permanently fixed or else detachable for the possible disassembling of the tool. The collar may advantageously consist of a ring which can be screwed on and is possibly provided with knurling. A balanced journaling is provided at both ends of the pivot pin and is furthermore characterized that the intermediate section engages rotatably in the coupled position of the handles into a depression on the inner flank of the crossing region. In this way the corresponding plier handle remains freely turnable.

Furthermore, another advantageous feature resides in the fact that the transversed plier handle, as a result of two handle sections which are at an angle to each other, forms a fillet (or throat) lying on the gripping side of the pivot pin. As a result of the corresponding angular relationship of the two sections, the section adjoining the pivot pin on the gripping side has the same course as the other plier handle. This results in a narrow neck of the pliers. For instance, where several pipelines extend parallel to each other, that the jaw of the pliers can be brought more easily to the place of use. The useful range of swing of the pliers is also increased. The fillet on the traversed shaped handle also has an advantage from a manufacturing standpoint since the axis of the milling cutter can penetrate deeper into the section of the plier handle, which is widened there, and the milling cutter can thus cut out the entire free-space recess practically from the one side.

As a further advantage a minimum spread position of the grip sections which takes the thickness of the fingers into consideration is provided. Thus the first plier handle, which handle bears the fitted pivot pin, contacts against a stop flank of the second plier handle, which flank lies on the jaw-side of the slot of the second plier handle. The region of material of this second plier handle, which region extends between the said stop flank and the local jaw, widens towards the grip-side end. Thus, upon increasing adjustment of the jaw opening, during which the grip sections of traditional water-pump pliers approach each other with practically parallel displacement, a finger slot now remains between the grip sections. Pinching of the fingers of the operating hand can be avoided, where a basic spread position of the grip sections which is suitable for use and better adapted to the ergonometric relationship of the operating hand is always present. This is achieved by simple structural means, without any additional parts. The increasing widening of said region, which region extends between said stop flank and the jaw, guides the grip section of the first plier handle upon the displacement of the width of the jaws in correspondingly increasing manner into an equilizing spaced position from the grip section of the second plier handle. It is furthermore of advantage here for the stop edge of the first plier handle to be formed by a recess shoulder lying spaced from the stop flank of the second plier handle, the stop edge for the position of maximum spread being formed by the edge of said recess shoulder facing away from the jaws. The latter has advantages in particular for the easy application of the tool. Thus the corresponding maximum limitation can be selected in such a manner that the other plier handle does not swing out of the range of the grip of the operating hand.

The object of the invention is described in further detail below with reference to illustrative embodiments shown in the drawing, in which:

FIG. 1 is a side view of the water-pump pliers;

FIG. 2 is a rear view thereof;

FIG. 3 is a broken away opposite side view of the pliers of FIG. 1 and shows the crossing region of the pliers with the arrangement of the leaf spring;

FIG. 11 is a rear view of FIG. 10;

FIG. 12 shows the crossing region of the pliers seen from the spring side, on an enlarged scale;

FIG. 13 is a sectional view along the line XIII—XIII of FIG. 9 on an enlarged scale; and FIG. 14 is a section along the line XIV—XIV of FIG. 13, both on an enlarged scale.

Figure 5:
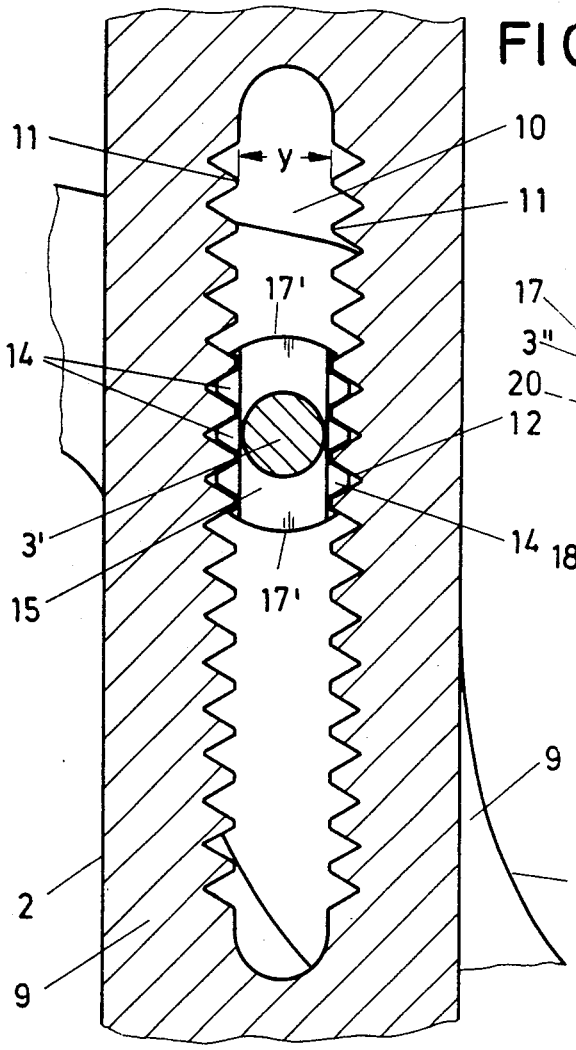
FIG. 5 is a sectional view along the line V—V of FIG. 4.

As seen in the figures, the water-pump pliers comprise two plier handles 1 and 2 which cross each other. The handles are connected to each other in the crossing region by a pivot pin 3. The plier handles 1 and 2 form plier jaws 4 and 5 respectively on the side above the crossing region and grip sections 6 to 7 respectively on the side below the crossing region. The gap of the plier jaw M is inclined (about 45°) to the grip sections 6, 7.

The plier handle 2 passes through a free space F in the plier handle 1 which corresponds to the thickness of the handle 2. The free space is developed as a slot which lies in the plane of swing of the handle and has handle longitudinal walls 8 of approximately the same thickness on its tow sides. These walls define an area of greater width than the width of the grip section 6. Approximately three times the width of the grip section 6 is present in the actual crossing region in this embodiment.

The traversing plier handle 2 has in the region of the free space F of the handle 1 a passage region 9 of a width which is clearly greater than the width of the grip section 7. This passage region is approximately at right angles to the plier jaw 5.

In order to change the size of the plier jaw M, the traversed plier handle 1 can be displaced in steps. The corresponding displacement device comprises a slot 10 which is passed through by the pivot pin 3. The slot 10 comprises its slot flanks 11 which extend parallel to each other. Slot flanks 11 define individual tooth gaps 12, which gaps are sawtooth-like in nature. The gaps 12 extend, like the pivot pin 3, transverse to the swing-actuation plane of the plier handles 1, 2.

Pivot pin 3 is fitted to and guided within a bore 13. Bore 13 cooperates with slot 10. Pivot pin 3 is divided, viewed axially, into a plurality of different cross sectional regions. One cross sectional region "a", corresponds in width to the toothed flak width "x", of slot 10. This region "a" bears on both sides teeth 14 corresponding to the width "x" for form-locked (positive) engagement in the tooth gaps 12 of slot flanks 11. The pivot pin 3 is developed basically with rotational symmetry, flattened symmetrically for this purpose on diametrically opposite sides to cooperate with the inside dimension "y" of the slot 10 in such a manner that upon the form-locked engagement of tooth gaps 12 and teeth 14, at least three teeth 14 on each side of region "a" are engaged thereby.

Between this cross-section region "a" which enables the above-said form-locked engagment, and a cylindrical cross-sectional region "b" of thinner diameter which is produced on the opposite end of pivot pin 3, there is a non-round intermediate cross-sectional region "c" at section 15. The width of section 15 is smaller and its length greater than the inside dimension "y" between the slot flanks 11. The cross-sectional region "c" of the intermediate section 15 is flattened, as is the cross-sectional region "a". The cross-sectional region "c" is so dimensioned in its axial length that, after elimination of the coupling engagement between teeth 14 and tooth gaps 12, it continues to be engaged in slot 10 and therefore secures the pivot pin 3 against turning by itself.

Bore 13 is defined within walls 8 of plier handle 1 and receives pivot pin 3. Bore 13 comprises a depression 16 formed in the right-hand longitudinal wall 8 of handle 1 (see FIG. 4) and has a diameter corresponding to bore 13. Thus, in the coupled position of plier handles 1, 2, there is no interference with the swinging movement of the plier handles 1, 2 with respect to each other. The remaining circular outer wall sections 17' of pivot pin 3 form peripheral supporting or guide zones for the pivot pin 3 and cooperate with the wall of bore 13.

Figure 4:
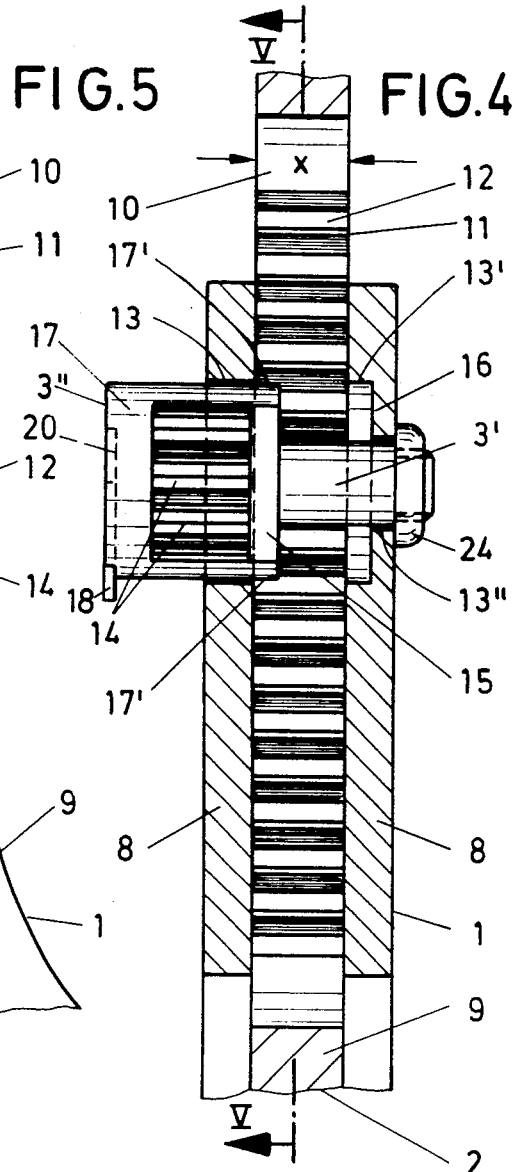
FIG. 4 is a sectional view along the line IV—IV of FIG. 1, on a larger scale.
Figure 8:
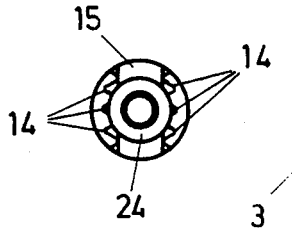
FIG. 8 is the corresponding side view, seen from the right.
Figure 6:
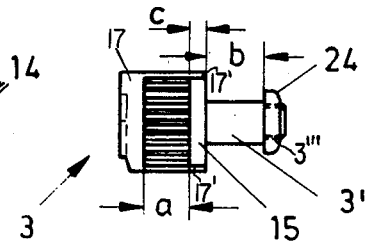
FIG. 6 is a side view of the pivot pin in natural size.
Figure 7:
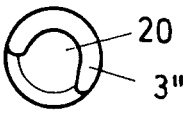
FIG. 7 is a corresponding side view, seen from the left.

When pivot pin 3 is fully engaged in bore 13, the solid cylindrical outer wall 17 of pivot pin 3 lies supported and guided on the wall of bore 13 on the other side of the slot 10, namely on the left-hand longitudinal wall 8 of handle 1 (see FIG. 4).

Adjoining the depression 16, the bore wall 13' defined in handle 1 is redefined into a smaller bore 13'' which is adapted the the circular diameter of the stepped end 3' of the pivot pin, so that a stop shoulder remains for the pivot pin 3 on the base of the depression 16.

The pivot pin 3 is spring loaded in the direction of maintaining the form-locked engagement of teeth 14 and gaps 12. The pivot pin 3 is acted on by a leaf spring 18 from the spring's free end 18' of solid cross-section. The leaf spring is seated on the outer side of the handle longitudinal wall 8 present there, where the wall surface thereat is provided with a groove 19 of a shape corresponding to and for recessed association with leaf spring 18. The leaf spring 18 assumes a contour which is adapted to plier handle 1. The depth of the groove 19 corresponds to the thickness of the material of the leaf spring 18, so that the outer side of the latter terminates flush with the outer surface of the handle longitudinal wall 8 present there. As can be noted from the drawings, the free end 18' of the leaf spring 18 grips over a sector-shaped depression 20 on the end 3'' of the pivot pin 3. The sector shape takes into account the required angle of swing of the plier handles 1, 2, with due consideration of the fact that the pivot pin 3 is held in non-turnable manner with respect to the plier handle 2, even in the uncoupled condition. Relative movement, i.e. turning movement of the pivot pin 3, takes place merely with respect to the traversed plier handle 1. For the fixing of the leaf spring 18 there is provided a screw 23 or other fastening element which passes through the other end of spring 18.

The limiting of the swing of the two plier handles 1, 2 with respect to each other is produced by stop edges 21 and 22 in the region of the free space F which is on the plier-jaw side. The stop edges are so located that the rounded end of the leaf spring which rests in the sector-shaped depression 20 is not placed under load. The stop edge 21 is so located that the position of minimum spread of the grip sections 6, 7 is the position which takes into account the thickness of the fingers of the operating hand H. The plier handle 1 which bears, fitted, the pivot pin 3, comes against a stop flank A of the other plier handle 2, which flank lies on the jaw side of the slot 10. The corresponding minimum distance of spread Z between the inner sides of the two grip sections 6,7 and is not decreased, even with maximum jaw sizes (see FIG. 10), where the fingers of the operating hand H which control the jaw M would be pinched between the inner sides of the two grip section 6, 7. In order to prevent the corresponding approach of the grip section 6 toward the grip section 7 upon the increasing of the jaw size, the width of the region of material of plier handle 2 which lies between the stop flank A and the slot 10 increases as this region extends toward the grip 7. The widening is substantially continuous. While the region of material in the jaw-side end of the slot 10 has a thickness of about 8 mm, the thickness in the opposite end region is about 11 mm, this with a length of slot of about 40 mm. The acute angle between stop flank A and slot flank 11 is designated $\beta$ and amounts to 2.5°. The stop flank A extends continuously up into the upper corner edge 28 of the jaw and therefore clearly beyond the upper end of slot 10.

Figure 9:
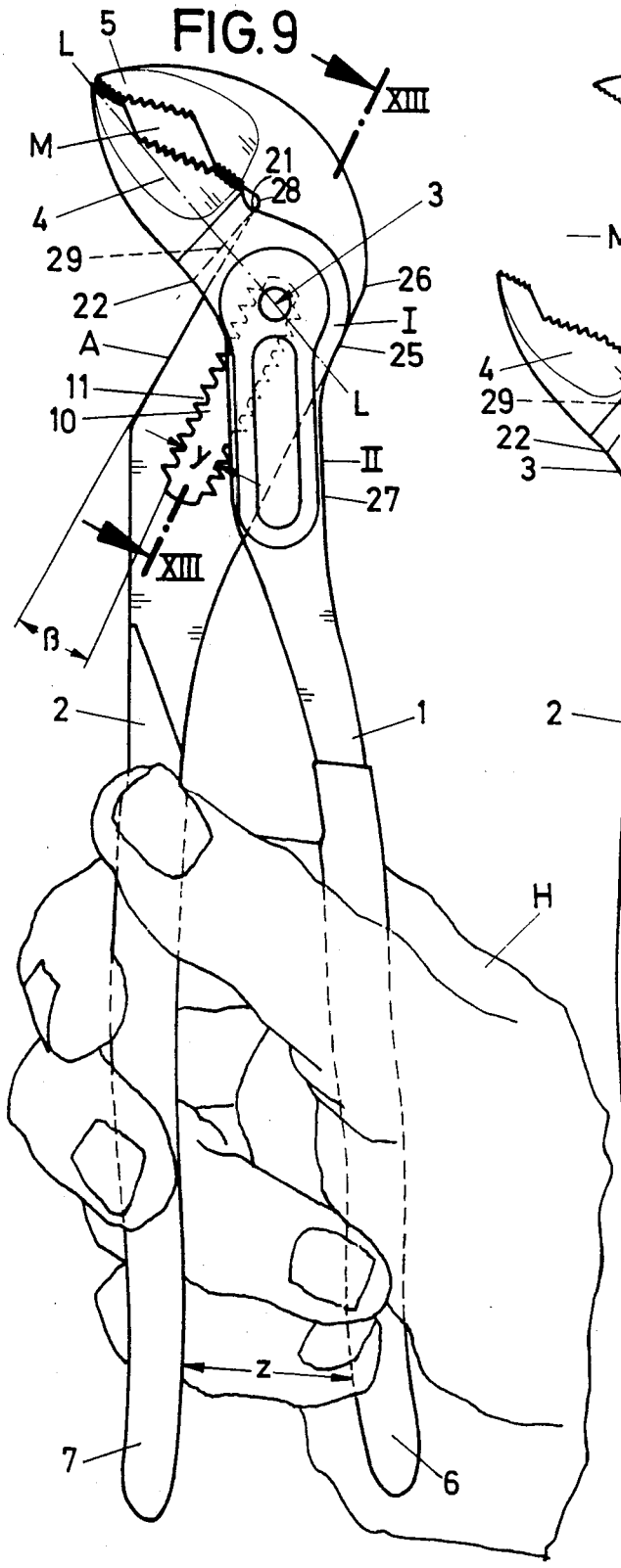
FIG. 9 is a side view of a modified form of the water-pump pliers with a small size jaw set.
Figure 10:
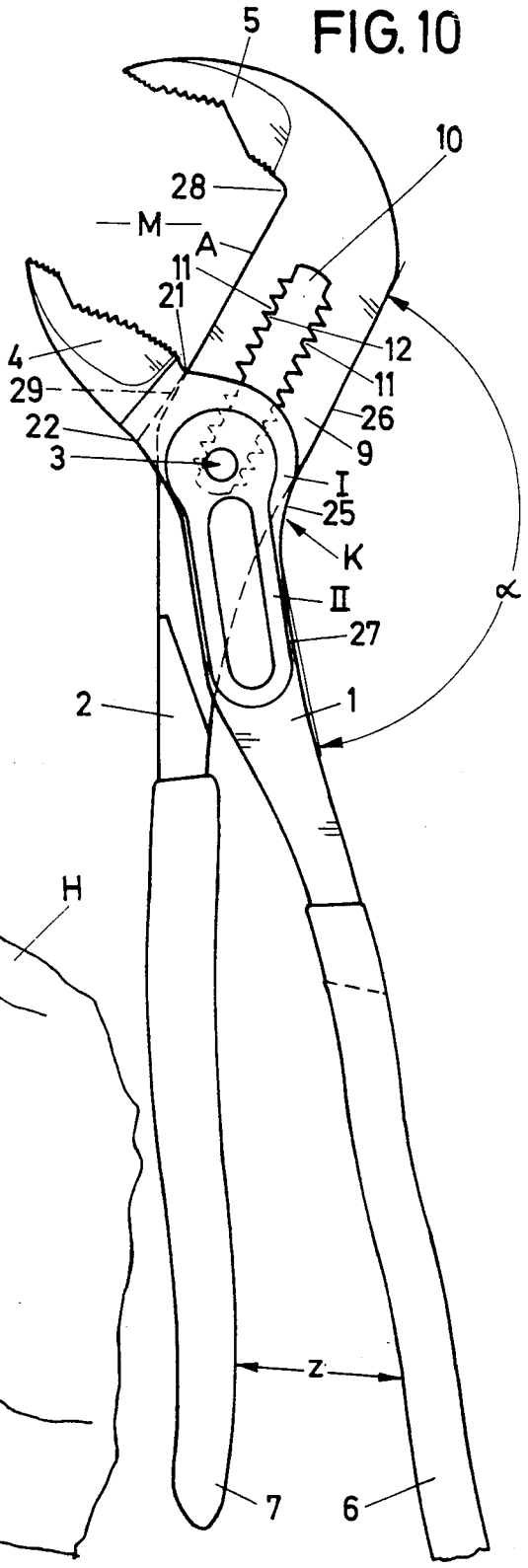
FIG. 10 is a corresponding side view of FIG. 9 but with the maximum size jaw set.

In an alternative embodiment, the stop edge 21 of plier handle 1, instead of being formed by the milled free space F, can, with a non-traversing arrangement of the handles in the crossing region, also be formed by a recess shoulder 29 of a mounting depression which is open towards the wide side and is spaced from the stop shoulder A. Recess shoulder 29 is employed analogously with respect to the milled free space F. The recess shoulder 29 is substantially transverse to an imaginary line L drawn between pivot pin 3 and the tip of the plier jaw 4 (FIG. 9). The stop edges 21 and 22 are approximately the same distance from the point of intersection of the line L and the recess shoulder 29. The path of swing of the plier handle 1, which is limited by the stop edges 21, 22 in both directions, respectively is so selected that the stop edge 22 holds the plier handle 1 at such a maximum distance of spread from the the plier handle 2 that the latter still lies in the region of grip of the fingers of the operating hand H and does not swing far away in uncontrolled fashion. With the maximum adjustment, the shoulder 29 can itself come against the stop if the taper in the grip section 7 commences early (FIG. 10).

Referring again to pivot pin 3, the free end of the cylindrical cross sectional region "b" of reduced cross section cooperates with a stop collar 24. This collar may consist of a screw ring. It is detachably screwed onto the stepped-down end 3''' of pivot pin 3, which is provided there accordingly with a thread. A fixed stop can, of course, also be created, for instance, by the formation of a collar by deforming the end of pivot pin 3 after assembly of the tool.

The traversed plier handle 1, as a result of two handle sections I and II which are at an angle to each other, forms a fillet or throat K which lies at the handle side of the pivot pin 3. The corresponding formation, when the plier grips are held parallel to each other, is such that the rear edge 25 of the handle section 1 (which section 1 extends inward toward the fillet) is approximately parallel to or co-planar with the outer edge 26 of the traversed plier handle 2. Consequently, the rear edge 27 of the handle section II (which Section II extends outwardly from the fillet) extends at an obtuse angle $\alpha$ to the outer edge 26 or rear edge 25. The angle $\alpha$ is about 140°. The fillet K assumes a concavely rounded course in the region of its vertex.

By the formation, the region behind the plier head becomes narrower, which facilitates the use of the tool. Furthermore, by this formation the possibility is obtained of permitting the milling cutter which produces the free space F to move in immediately to the full depth from one side, where no change in position of the tool part is necessary.

The manner of adjusting the water-pump pliers is now described. In order to adjust the jaw size it is merely necessary to shift the pivot pin axially from the side having the stop collar 24, i.e. transverse to the plane of movement of the plier handles, against the tension of spring 18. By the striking of the stop collar 24 against the outer surface of the handle longitudinal wall 8 present thereat, the teeth 14 of the pivot pin and the tooth gaps 12 of the slot 10 are disengaged. The pivot pin 3 can now be shifted, together with the plier handle 1 which bears it, in the lengthwise direction of the slot 10 By releasing the stop collar 24, the spring 18 effects the desired form-locked downward displacement of the one plier handle 1, the engagement of teeth 14 and tooth gaps 12, where only a minor correction is necessitated to fully seat teeth 14 in tooth gaps 12. As well, to effect such tooth and gap cooperation, equal-angle "V" tooth surfaces can be used.

In one embodiment, upon increasing downward displacement of the one plier handle 1, the one plier handle is increasingly spread away by the stop flank A, which flank ascends increasingly in width with respect to slot 10, such that a minimum distance Z between the handle grip sections 6, 7 is maintained.

We claim:

1. In a pair of water-pump pliers having first and second plier handles which cross with respect to each other, traverse one within the other and are pivotally connected together with respect to one another by a pivot pin, said handles forming a plier jaw respectively above the crossing region of said handles and grip sections respectively below said region, wherein said first plier handle is displaceable in respective steps relative to said second plier handle in said region in order to change the spread of the plier jaws, wherein said second plier handle is formed with a longitudinal slot with profiled flanks, said pivot pin having at least first and second cross-sectional regions, the latter being smaller in cross-section than the former, said first cross-sectional region being engaged in said slot at the, and securing the, respective displaceable steps of said handles relative to each other, and wherein for disengaging from slot said pivot pin being displaceable axially transversely to the longitudinal plane of the pliers against spring biasing of a spring such that said second cross-sectional region of said pivot pin enters the longitudinal slot and is displaceable freely in and over the entire length of said longitudinal slot, the improvement comprising:

means for preventing said pivot pin from turning with respect to said second plier handle when said first cross-sectional region is disengaged from said slot, said means comprises an elongated section of said pivot pin, and said elongated section when said first cross-sectional region is disengaged from said slot being disposed in said slot, displaceable freely in and over the entire length of said longitudinal slot, and form-locking in said slot so as to prevent said pivot pin from turning with respect to said second plier handle.

2. The pair of water-pump pliers according to claim 1, wherein said elongated section is an intermediate section on said pivot pin between said first cross-sectional region and said second cross-sectional region, wherein said intermediate section has a slightly smaller width and greater length than the inside dimension of the flanks of said slot and is located between said flanks at least when said first cross-sectional region is disengaged from said slot.

3. The pair of water-pump pliers according to claim 1, wherein said spring comprises a leaf spring having a free end which lies in a sector-shaped depression defined at the end of said pivot pin, said leaf spring has a fixed end secured to an outer of said plier handles.

4. The pair of water-pump pliers according to claim 3, wherein said outer handle is said first plier handle which is formed with a groove on an outer surface thereof, wherein said leaf spring lies within said groove.

5. The pair of water-pump pliers according to claim 3, further comprising a stop collar, wherein said stop collar is mountable on said second cross-sectional region at a freely projecting free end of said pivot pin which is adapted to be pressed for disengagement of said first cross-sectional region from said slot.

6. The pair of water-pump pliers according to claim 2, wherein a depression is defined on a flank of said first plier handle at said crossing region facing said slot and wherein said intermediate section extends turnably into said depression when said first cross-sectional region is engaged in said slot.

7. The pair of water-pump pliers according to claim 1, wherein said first plier handle comprises first and second handle sections, said handle sections being at an angle to each other and forming a fillet, said fillet being formed on the grip side of said pivot pin.

8. The pair of water-pump pliers according to claim 1, wherein said first plier handle in a stopped position abuts against a stop shoulder of said second plier handle to define a minimum spread position between said grip sections to provide finger clearance, said stop shoulder lies on the jaw side of said slot, and wherein the region of material of said second plier handle which extends between said stop shoulder and said slot widens towards its grip-side end.

9. The pair of water-pump pliers according to claim 8, wherein said first plier handle further comprises a first and second stop edge, said first stop edge being formed by a recess shoulder lying spaced from said stop shoulder of said second plier handle, the edge of another shoulder of said first plier handle facing away from said jaws forming said second stop edge, the latter of which determines the position of maximum spread of said jaws.

10. The pair of pliers according to claim 1, wherein said first cross-sectional region is formed with teeth, and said first cross-sectional region being engaged in said slot by said teeth engaging in said profiled flanks of said slot, said teeth in all positions of said handles and pivot pin being aligned in a single orientation with respect to said profiled flanks of said slot.

11. The pair of pliers according to claim 10, wherein said teeth are formed on diametrically opposite sides of said first cross-sectional region and engage in said profiled flanks respectively on opposite longitudinal sides of said longitudinal slot.

12. A pair of pliers comprising first and second plier handles crossing and traversing one another, said second plier handle defines a longitudinal slot having profiled flanks, a pivot pin adjustably coupling said first and second plier handles with respect to each other, said pivot pin having a profiled first cross-sectional region, said pivot pin extending and engageable via said first cross-sectional section in said longitudinal slot in said profiled flanks thereof, a spring biasing said pivot pin, said pivot pin being displaceable axially and transversely to the longitudinal plane of the pliers against said spring biasing of said spring such that said profiled first cross-sectional region of said pivot pin disengages from said profiled flanks and said pivot pin is displaceable freely in and over the entire length of said longitudinal slot, said handles adjustably defining a pair of jaws at one end of the pliers and gripping sections at the other end, and means for preventing said pivot pin from turning with respect to said second plier handle when said profiled first cross-sectional region of said pivot pin disengages from said profiled flanks of said slot.

13. The pair of pliers according to claim 12, wherein said pivot pin has a second cross-sectional region, said first cross-sectional region is defined by a first end of said pivot pin and having teeth for form-locked engagement with said profiled flanks of said slot, said second cross-sectional region is defined by the other end of said pivot pin, said second cross-sectional region being contoured to be freely displaceable in said slot, said means comprising an intermediate section on said pivot pin lying between said first and said second cross-sectional region.

14. The pair of pliers according to claim 13, wherein said intermediate section is elongated having a smaller width and greater length than the inside dimension of said slot flanks.

15. The pair of pliers according to claim 14, wherein said second plier handle traverses centrally through said first plier handle, said spring is a leaf spring coupled at one of its ends to said first plier handle and pressing at its other end on said pivot pin, such that said pivot pin is spring-biased into said form-locked engagement of said teeth with said profiled flanks of said slot.

16. The pair of pliers according to claim 15, wherein a sector-shaped depression is defined at said first end of said pivot pin, and said leaf spring at its uncoupled end lies in said sector-shaped depression.

17. The pair of pliers according to claim 16, wherein said first plier handle defines a groove in a first outer surface thereof, wherein said leaf spring lies within said groove, said pliers further comprising a stop collar, and wherein said stop collar is mountable on said other end of said pivot pin, said other end projecting from a second outer surface of said first plier handle remote from said first outer surface.

18. The pair of pliers according to claim 13, wherein said handles define a crossing region at the location of said said pivot pin, wherein a depression is defined on the inner flank of said first plier handle at said crossing region and wherein said intermediate section extends turnably into said depression during said form-locked engagement of said teeth with said profiled flanks of said slot.

19. The pair of pliers according to claim 12, wherein each said handle comprises a grip section, and wherein said first plier handle comprises first and second handle sections, said handle sections being at an angle to each other and forming a fillet, said fillet being formed on the grip side of said pivot pin.

20. The pair of pliers according to claim 19, wherein said angle is approximately 140° measured from the outer edge of said second plier handle to the rear edge of said second handle section when said plier handle grip sections are held parallel to each other.

* * * * *